US007196598B2

(12) United States Patent
Maruhashi et al.

(10) Patent No.: US 7,196,598 B2
(45) Date of Patent: Mar. 27, 2007

(54) DIELECTRIC WAVEGUIDE FILTER WITH INDUCTIVE WINDOWS AND COPLANAR LINE COUPLING

(75) Inventors: Kenichi Maruhashi, Tokyo (JP); Masaharu Ito, Tokyo (JP); Keiichi Ohata, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/332,348

(22) PCT Filed: Jul. 6, 2001

(86) PCT No.: PCT/JP01/05893

§ 371 (c)(1),
(2), (4) Date: Apr. 10, 2003

(87) PCT Pub. No.: WO02/05378

PCT Pub. Date: Jan. 17, 2002

(65) Prior Publication Data

US 2003/0156806 A1 Aug. 21, 2003

(30) Foreign Application Priority Data

Jul. 7, 2000 (JP) ..... 2000-207460

(51) Int. Cl.
*H01P 1/028* (2006.01)

(52) U.S. Cl. ..... 333/212; 333/230
(58) Field of Classification Search ..... 333/208, 333/212, 230
See application file for complete search history.

(56) References Cited

U.S. PATENT DOCUMENTS

| | | | | |
|---|---|---|---|---|
| 5,382,931 | A * | 1/1995 | Piloto et al. | 333/208 |
| 6,535,083 | B1 * | 3/2003 | Hageman et al. | 333/210 |
| 6,677,837 | B2 * | 1/2004 | Kojima et al. | 333/208 |
| 6,778,041 | B2 * | 8/2004 | Takahashi et al. | 333/202 |

FOREIGN PATENT DOCUMENTS

| | | |
|---|---|---|
| JP | 49-74463 | 7/1974 |
| JP | 10-93311 A | 4/1998 |
| JP | 10-107518 A | 4/1998 |
| JP | 10-303611 A | 11/1998 |
| JP | 11-186836 A | 7/1999 |
| JP | 11-274815 A | 10/1999 |
| JP | 11-284409 A | 10/1999 |
| JP | 11-312760 A | 11/1999 |
| JP | 11-312903 A | 11/1999 |
| JP | 11-346103 A | 12/1999 |

* cited by examiner

*Primary Examiner*—Benny Lee

(57) ABSTRACT

The present invention provides a filter exhibiting excellent filter characteristics and having less number of stages. A dielectric substrate (1) has one surface connected to a top conductor (2) and an opposite surface connected to a bottom conductor (3). A pair of rows of via-holes connecting together the top conductor (2) and the bottom conductor (3) are formed along the signal transfer direction. A slit (6) is formed in a portion of the top conductor (2) overlying the central resonator among a plurality of resonators. The slit (6) extends in a direction perpendicular to the signal transfer direction. Slits (7, 8) are formed in each of portions of the top conductor (2) overlying resonators disposed at both ends. A coplanar waveguide (9) mounted on the top conductor (2) is connected to the slit (7).

15 Claims, 9 Drawing Sheets

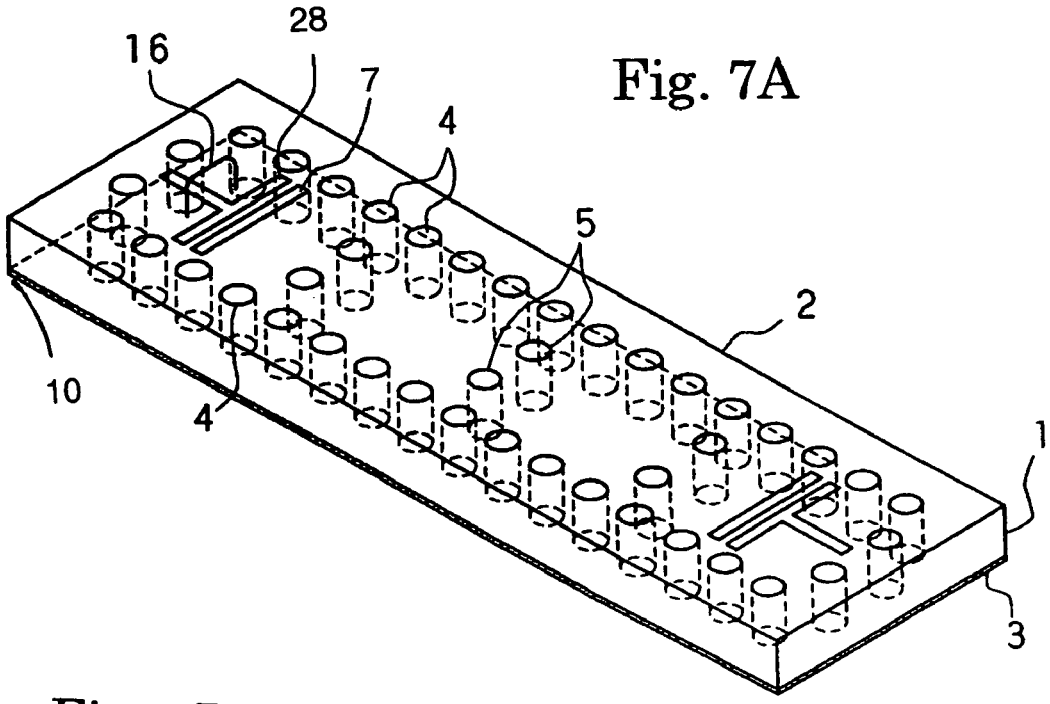
Fig. 7A
Fig. 7B
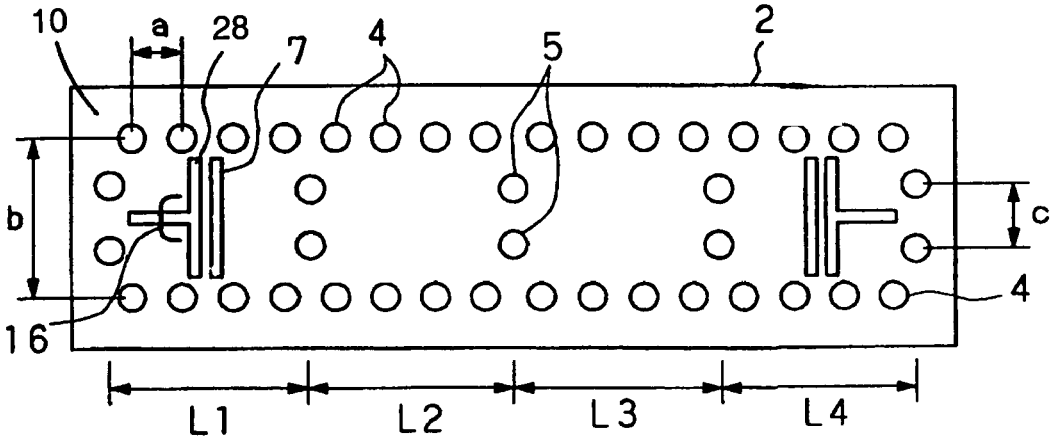

DIELECTRIC WAVEGUIDE FILTER WITH INDUCTIVE WINDOWS AND COPLANAR LINE COUPLING

TECHNICAL FIELD

The present invention relates to a filter having a waveguide tube structure for use as a high-frequency component.

TECHNICAL BACKGROUND

Typical waveguide tube filters used in microwave and millimeter-wave bands are realized by using a resonator structure including a metallic waveguide tube formed in a drawn structure. This type of the filters has a drawback in larger dimensions although it is superior in the performance thereof.

Thus, as recited in JP Patent Application 10-82184, a pseudo waveguide tube band-pass filter is devised which has a side wall of the waveguide tube configured by metallic via-holes in a dielectric substrate. As a practical example, FIGS. 9A and 9B show the schematic structure of a filter 10 having a four-stage configuration. FIG. 9A is a perspective view thereof, whereas FIG. 9B is a top plan view thereof. Referring to FIG. 9A, a top conductor 2 is formed on one of the surfaces of the dielectric substrate 1, whereas a bottom conductor 3 is formed on the opposing surface thereof. Via-holes 4 connecting together the top conductor 2 and the bottom conductor 3 are formed in two rows along the signal transfer direction. The spacing "a" between adjacent via-holes is equal to or below ½ of the in-tube wavelength. This structure is construed as a pseudo waveguide tube having a waveguide tube cross section defined by the thickness of the dielectric and the spacing "b" between the two arranged rows of the via-holes 4. Pairs of via-holes 5 are also formed in the waveguide tube to configure resonators having cavity lengths of L1, L2, L3 and L4. By suitably selecting the spacing "c" between the via-holes 5 forming a pair, frequencies other than the resonant frequency can be effectively reflected. On the other hand, a signal in the resonant frequency passes therethrough to achieve a desired filter function. In this filter, the dimensions of the filter are reduced down to about $1/(\sqrt{\epsilon})$ compared to a waveguide tube having a hollow interior (c is the relative permittivity of the dielectric).

On the other hand, a filter is often used which is configured by using a micro-strip line on a dielectric substrate. This filter has relatively smaller dimensions and can be connected to a planar circuit, such as an integrated circuit, by wire bonding, thereby allowing the filter to be mounted in a high-frequency module with ease.

Sometimes it is desirable for the above waveguide tube filter to have smaller dimensions. For example, the dimensions of the microwave or millimeter-wave integrated circuit formed on a semiconductor device are of around 5 mm square at a maximum. Accordingly, if a small-size multi-chip module is to be implemented by using an integrated circuit, it is generally important to reduce the dimensions of passive components such as filters. In addition, it is generally difficult to connect the filter to a planar circuit. Thus, a filter is desired which can be mounted and connected with ease and without enlarging the dimensions and adding a particular conversion circuit.

On the other hand, the filter using the micro-strip line sometimes assumes a characteristic change upon mounting the filter in a package structure. This results from the fact that the electromagnetic field in the micro-strip line is distributed up to the top portion thereof and can thus be susceptible to the effects of attaching a cap member thereto.

In the connection structure using the wire bonding technique, especially in the higher frequency range such as millimeter wave band, there arises a characteristic change caused by variation of the bonding wire length or by variation of the parasitic inductance component determined by the bonding wire length. Such a characteristic change is not negligible, and becomes a factor of reducing the product yield in a mass production. For solving this problem, a flip-chip mounting technique has been developed wherein the millimeter-wave semiconductor integrated circuit is mounted with face-down mounting onto a mounting board and connected thereto by using bumps. This technique is described, for example, in "IEEE International Solid-State Circuits Symposium, Digest" pp. 324–325, 2000, by K. Maruhashi et al. When the flip-chip mounting technique is applied, the connection between each element and the mounting board is implemented by a relatively short distance (200 micrometers or less), whereby the influence by the parasitic inductance component in the wire bonding technique becomes negligible. For applying the flip-chip mounting technique to the filter as well, the filter should have a terminal adapted to a coplanar waveguide, which is generally used for connection between elements, and should have a structure wherein the face-down mounting minimally changes the filter characteristic, and thus such a filter has been strongly desired.

SUMMARY OF THE INVENTION

In view of the above, it is an object of the present invention to provide a small-dimension filter having a dielectric waveguide tube structure and excellent filter characteristics even in the case of a smaller number of stages, and to provide a filter capable of being mounted by a flip-chip mounting technique without providing a particular external terminal thereto for connection with a planar circuit.

The present invention provides, in a first aspect thereof, a filter including a rectangular waveguide tube structure filled with dielectric, wherein the rectangular waveguide structure configures therein at least one resonator, characterized in that:

at least one slit is formed in a longer-side conductor plane of the waveguide tube structure.

The present invention provides, in a second aspect thereof, a filter including a rectangular waveguide tube structure including a pair of first conductor planes formed on top and bottom surfaces of a dielectric substrate, and a pair of second conductor planes formed on side surfaces of the dielectric substrate, wherein the first conductor planes constitute longer-side conductor planes, and the rectangular waveguide tube structure configures therein at least one resonator, characterized in that:

at least one slit is formed in one of the longer-side conductor planes of the waveguide tube structure.

The present invention provides, in a third aspect thereof, a filter including:

a rectangular waveguide tube structure including a pair of conductor planes disposed on top and bottom surfaces of a dielectric substrate, wherein the conductor planes on the top and bottom surfaces constitute longer-side conductor planes, conductor via-holes formed in the dielectric substrate, and the rectangular waveguide tube structure configures at least one resonator, characterized in that:

at least one slit is formed in one of the longer-side conductor planes of the waveguide tube structure.

In accordance with the filters of the present invention, it is preferable that the slit be in a portion of the longer-side conductor plane of the waveguide tube structure configuring a central resonator among an odd number of resonators arranged.

In addition, it is preferable the slit extend in a direction perpendicular to the signal transfer direction.

It is also preferable that the conductor plane configuring the waveguide tube structure mount thereon a coplanar waveguide, and the coplanar waveguide be connected to the slit. In such a case, the coplanar waveguide and a circuit board for mounting thereon the filter are connected together via a bump.

It is also preferable that a slot line is mounted on a conductor plane configuring the waveguide tube structure, and that the slot line is connected to the slit. In such a case, the slot line and a circuit board, on which the filter is mounted, are connected together via a bump.

BRIEF DESCRIPTION OF THE DRAWINGS

FIGS. 1A and 1B show the configuration of a filter according to a fourth embodiment of the present invention, wherein FIG. 1A is a perspective view and FIG. 1B is a top plan view.

FIGS. 2A and 2B show a configuration of a filter according to a first embodiment of the present invention, wherein FIG. 2A is a perspective view and FIG. 2B is a top plan view.

FIGS. 4A and 4B show the configuration of a filter according to a second embodiment of the present invention, wherein FIG. 4A is a perspective view and FIG. 4B is a top plan view.

FIGS. 7A and 7B show a filter according to a third embodiment of the present invention, wherein FIG. 7A is a perspective view and FIG. 7B is a top plan view.

FIGS. 9A and 9B show a conventional filter, wherein FIG. 9A is a perspective view and FIG. 9B is a top plan view.

BEST MODES FOR WORKING THE INVENTION

Figure 2A:
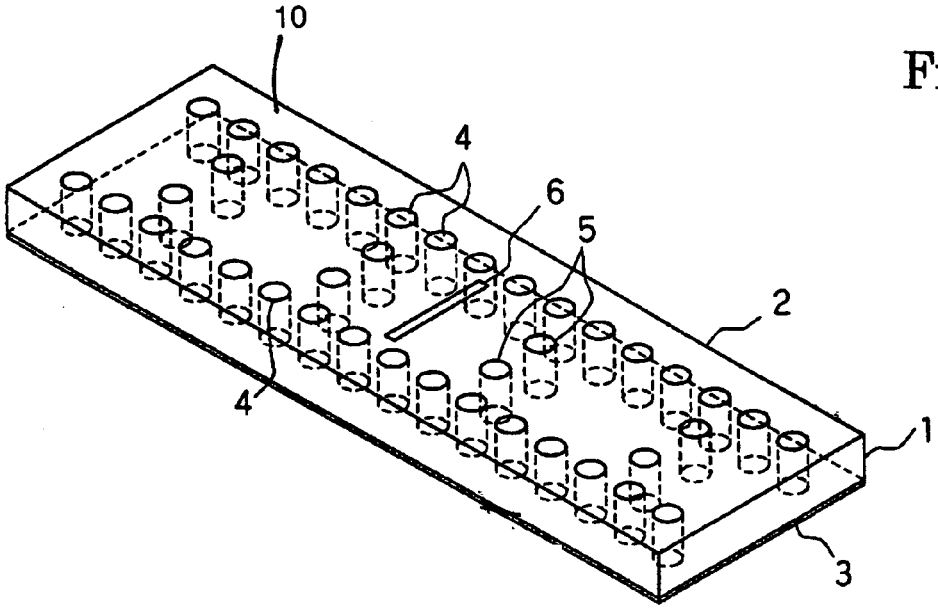
Figure 2B:
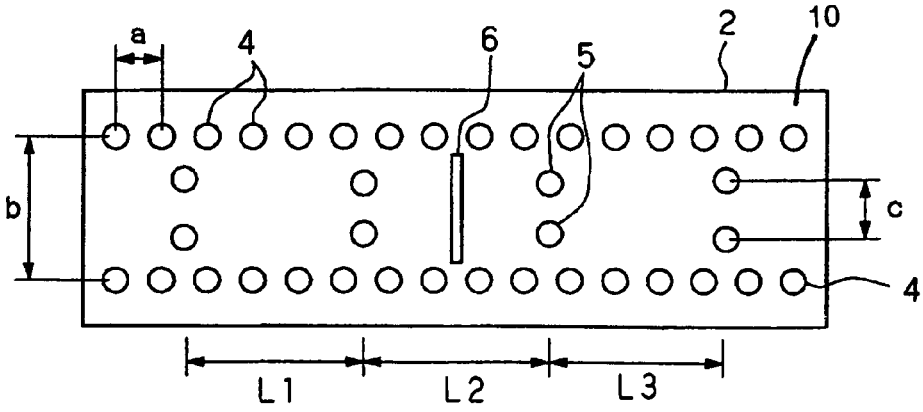

Hereinafter, the present invention is more specifically described based on the preferred embodiments thereof with reference to the drawings. Like reference labels in different drawing figures refer to the same feature and may be described in detail for all drawing figures. Referring to FIGS. 2A and 2B, there is shown the schematic structure of a filter 10 according to a first embodiment of the present invention. FIGS. 2A and 2B show the schematic structure of a filter 10 having a three-stage configuration. FIG. 2A is a perspective view thereof, whereas FIG. 2B is a top plan view thereof. A dielectric substrate 1 is provided with a pair of longer-side conductor planes, relative to the rectangular waveguide filter cross-section, a top conductor 2 formed on a surface thereof, and a bottom conductor 3 formed on the opposing surface thereof. Via-holes 4 connecting together the top conductor 2 and the bottom conductor 3 are formed in two rows parallel to a signal transfer direction. The spacing "a" (FIG. 2B) between adjacent via-holes 4 is preferably equal to or below ½ of the in-tube wavelength. This structure can be construed as a pseudo waveguide tube having a waveguide-tube cross-section defined by the thickness of the dielectric substrate (in a shorter side) and the spacing "b" (FIG. 2B) between the two arranged rows of the via-holes 4 (in a longer side). In the waveguide tube, pairs of via-holes 5 are further formed, thereby configuring resonators having cavity lengths of L1, L2 and L3 as shown in FIG. 2B. By suitably selecting the spacing "C" (FIG. 2B) between the via-holes 5 forming a pair, frequencies other than a resonant frequency can be reflected. On the other hand, a signal in the resonant frequency passes therethrough to achieve a desired filter property.

Still referring to FIGS. 2A and 2B, the present filter has a three-stage structure including three resonators therein, wherein a portion of the top conductor 2 overlying the central resonator is provided with a slit 6 formed by partially removing the top conductor 2 or the bottom conductor 3, where partial removal of the top conductor 2 is shown, and partial removal of the bottom conductor 3 is not shown. The slit 6 is preferably arranged to extend in a direction perpendicular to the signal transfer direction.

Figure 3:
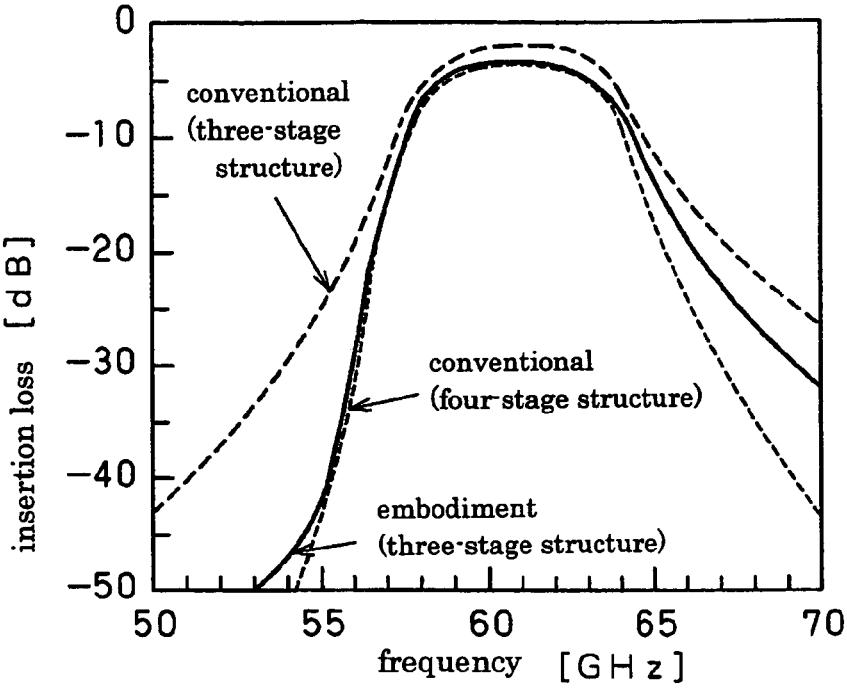
FIG. 3 is a graph showing the filter characteristic of the first embodiment of the present invention.

FIG. 3 shows the filter insertion losses characteristic as a function of frequency in the present embodiment. Insertion losses for conventional 3 and 4 stage filters are also shown. FIGS. 2A and 2B both have a 3-dB band pass similar to the 3-dB band pass of the present embodiment. For example, the insertion loss in the present embodiment is 40 dB at a frequency (55 GHz) which is 6 GHz apart from the central frequency, 61 GHz, toward a lower frequency side. This value is higher than the insertion loss, 25 dB, of the conventional three-stage filter and is approximately equal to the value, 42 dB, of the conventional four-stage filter. That is, according to the present embodiment, an excellent suppression amount for the undesired-frequency-band signal is obtained even in the case of using a less number of stages compared to the conventional technique. Accordingly, the filter has smaller dimensions, whereby lower costs for the filter itself or smaller dimensions of a high-frequency circuit module having such a filter can be achieved.

The operational principle of the present embodiment is that the introduction of the slit 6 provides an attenuation pole in the lower frequency range to thereby raise the suppression amount of the undesired-frequency-band signal. In the present embodiment, the attenuation pole is formed in the lower frequency range; however, the attenuation pole may be formed in the higher frequency range by adjusting the slit length. It is found that the frequency at which the attenuation pole appears is easily adjusted, without changing the other structural parameters, by changing the slit length for the slit provided above the central resonator among an odd number of the resonators provided in the filter. In addition, the slit may extend between the via-holes 4, if desired, and can be extended beyond the waveguide tube structure by increasing the length thereof, and accordingly, a higher design choice can be obtained. Moreover, by providing slits having different lengths above a plurality of resonators, attenuation poles can be provided on both the higher frequency side and the lower frequency side.

It is to be noted that although the signal electromagnetic field leaks from the internal of the pseudo waveguide tube through the slit, the signal electro-magnetic field leak is lower due to the dielectric residing within the pseudo waveguide tube. Accordingly, if it is incorporated in a module, for example, and covered by a cap, the leak due to the filter characteristic is lower.

The filter of the present embodiment can be easily manufactured by using a well-known alumina-ceramic-substrate process etc. More specifically, the filter may be manufactured, while using a ceramic-material sheet, by the steps of forming via-holes, filling therein with metallic paste, baking, forming an interconnection film (forming slit), plating with gold etc. It is to be noted that the material for the substrate, the process for forming the via-holes and the process for forming the slit are not limited in the present invention. In addition, although the via-holes 4 are exemplarily formed in two rows along the signal transfer direction, any number of rows may be employed so long as the pseudo waveguide tube is configured thereby.

Figure 4A:
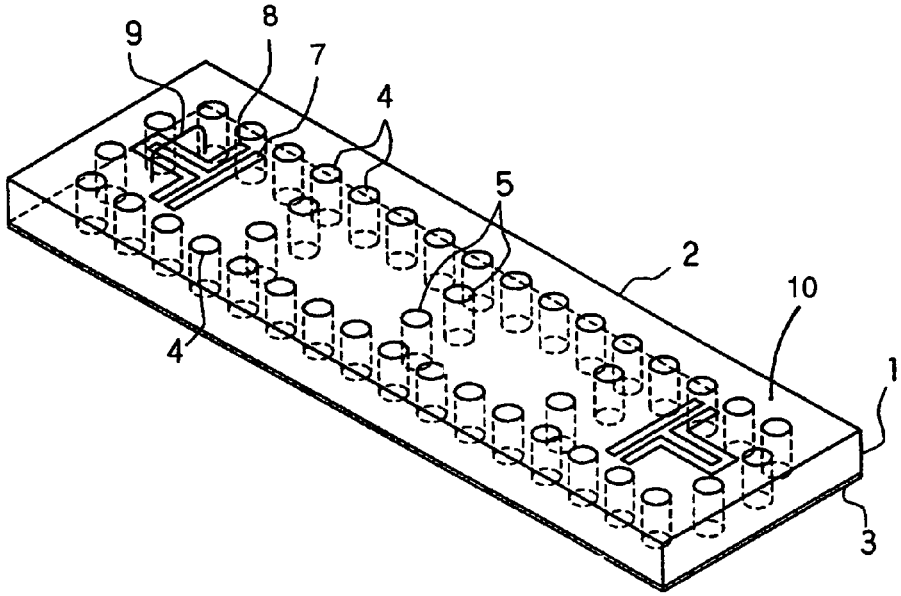
Figure 4B:
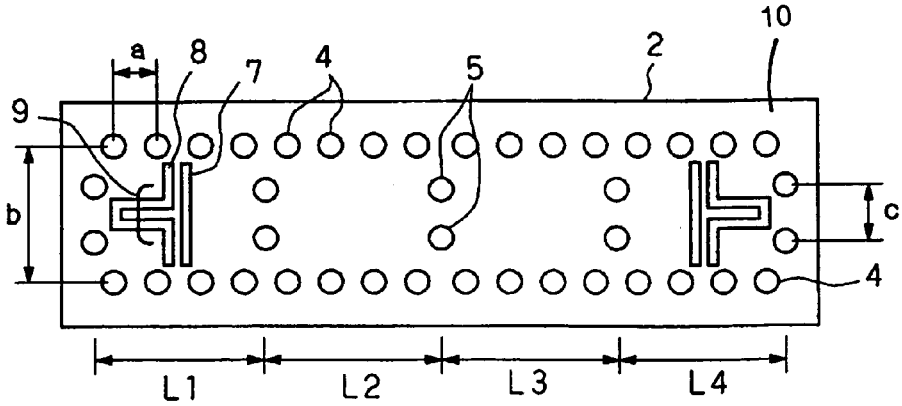

Referring to FIGS. 4A and 4B, there is shown the schematic structure of a filter 10 according to a second embodiment of the present invention. FIGS. 4A and 4B show the schematic structure of a filter 10 having a four-stage configuration. FIG. 4A is a perspective view thereof, whereas FIG. 4B is a top plan view thereof. A dielectric substrate 1 is provided with a top conductor 2 formed on one surface thereof, and a bottom conductor 3 formed on the opposite surface thereof. Via-holes 4 connecting the top conductor 2 and the bottom conductor 3 (FIG. 4A) together are formed in two rows along the signal transfer direction. Side conductor planes 20 and 30 are not shown, but are present as in FIG. 2A. It is preferable that the spacing "a" (FIG. 4B) between adjacent via-holes be equal to or less than ½ of the in-tube wavelength. This structure can be construed as a pseudo waveguide tube having a waveguide-tube cross section defined by the thickness of the dielectric and the spacing "b" (FIG. 4B) between the two arranged rows of the via-holes 4. In addition, pairs of via-holes 5 are formed in the waveguide tube to thereby configure resonators having cavity lengths of L1, L2, L3 and L4 as shown in FIG. 4B. By suitably selecting the spacing "c" (FIG. 4B) between the via-holes 5 forming a pair, frequencies other than the resonant frequency can be reflected. On the other hand, a signal in the resonant frequency passes therethrough to thereby obtain a desired filter performance. The present filter 10 has a four-stage structure including four resonators therein, wherein each of portions of the top conductor 2 overlying the outermost end resonators is provided with slits 7 and 8 formed by partially removing the conductor. A coplanar waveguide 9 formed on the top conductor 2 overlying the resonator is connected to the slit 7.

Figure 9A:
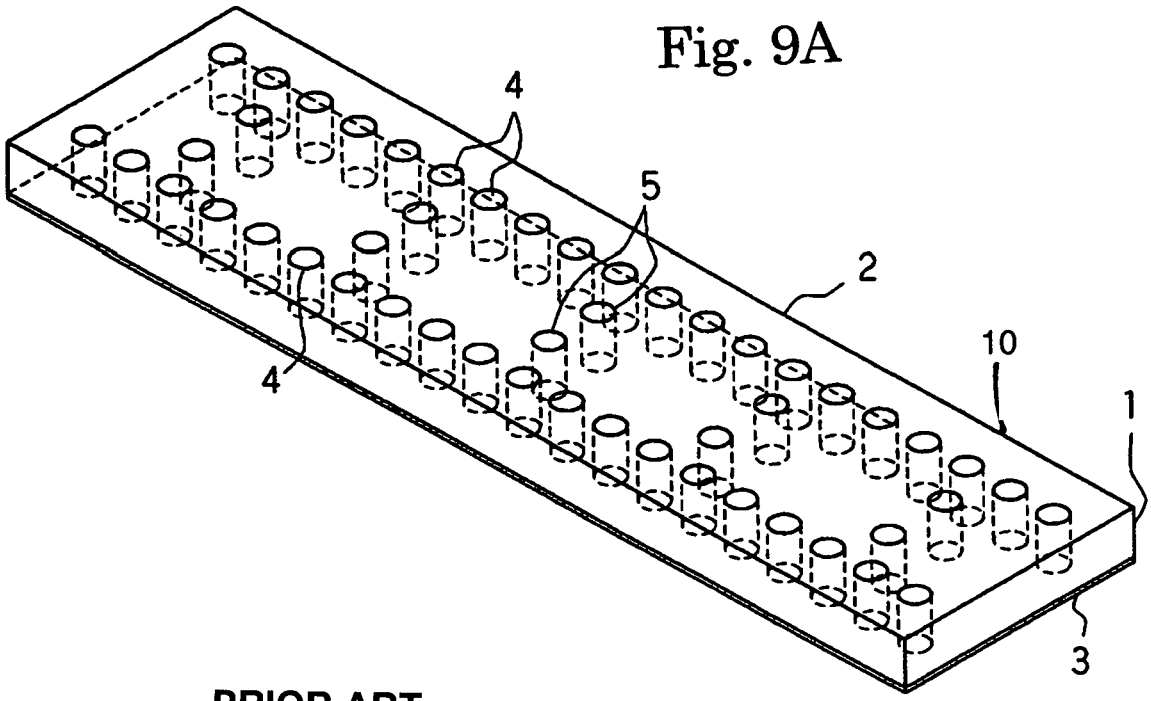
PRIOR ART Fig. 9A
Figure 9B:
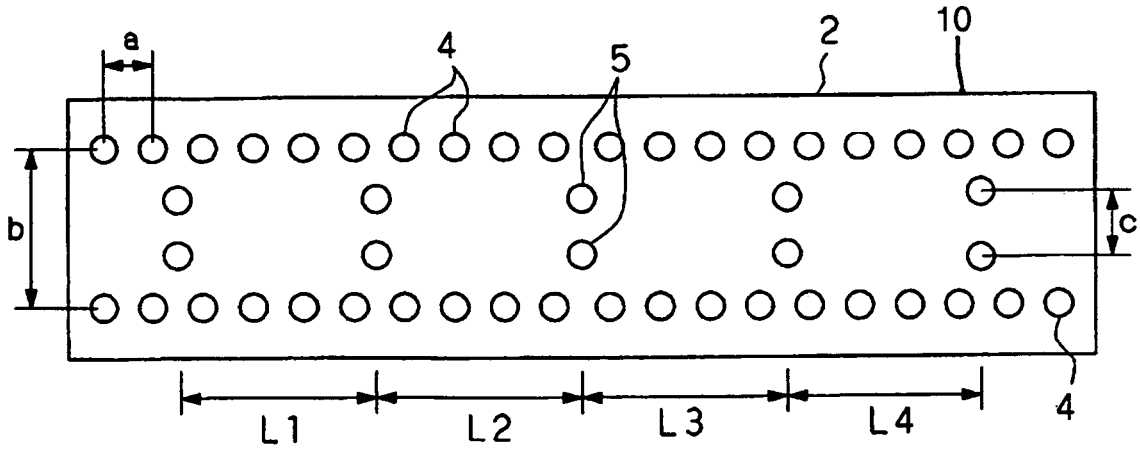
PRIOR ART Fig. 9B

Still referring to FIGS. 4A and 4B, in accordance with the second embodiment of the present invention, the coplanar waveguide 9 formed overlying the resonator constitutes a terminal for external connection. Accordingly, it can be manufactured with reduced dimensions compared to the conventional technique (FIG. 9) which necessitates another terminal (not shown) in the signal transfer direction. In addition, it can be connected to a planar circuit by using a bonding wire technique without using an additional and specific conversion section. It is to be noted that although the signal's electromagnetic field leaks from the internal of the pseudo waveguide tube through the slit, the influence thereby is lower due to the dielectric residing within the pseudo waveguide tube. Accordingly, if it is incorporated in a module for example, and covered by a cap, the leak due to the filter characteristic is lower.

Figure 5:
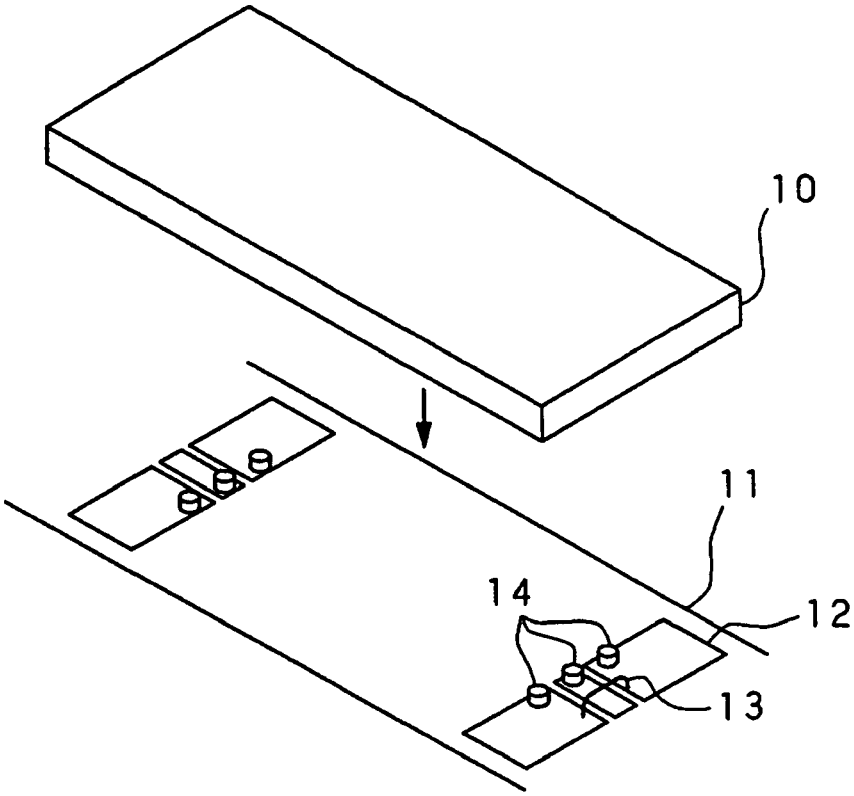
FIG. 5 is an explanatory view of the mounting structure of the filters according to the second and fourth embodiments of the present invention.
Figure 6:
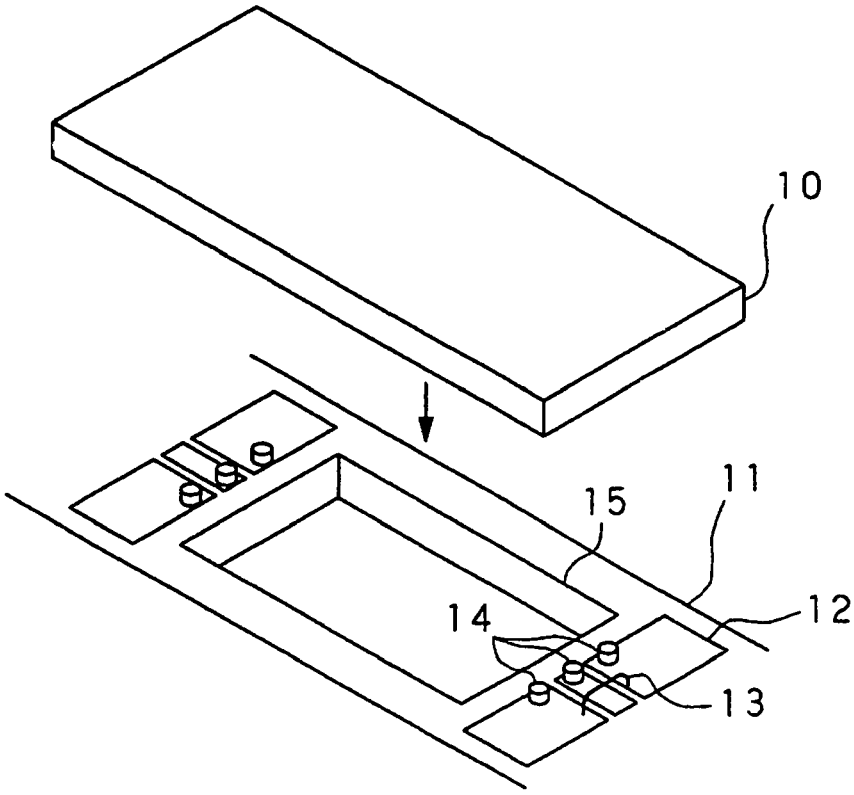
FIG. 6 is another explanatory view of the mounting structure of the filters according to the second and fourth embodiments of the present invention.

FIG. 5 shows the mounting technique used for a filter 10 according to the present invention. A coplanar waveguide 13 is formed using a conductor pattern 12 on the mounting board 11, on which the filter 10 of the present embodiment is to be mounted. Bumps 14 are formed on the mounting board 11 and these bumps 14 may comprise gold as a main component, for example. The filter 10 is mounted on the mounting board 11 and electrically connected to the circuitry on the mounting board 11 via bumps 14. Integrated circuits, other than the recited filter, may be mounted onto this mounting board in addition to or in exclusion of the recited filter. In an exemplary embodiment of the present invention, solder bumps can be used for bumps 14 and the bumps may be formed on the filter side instead of the mounting board 11 side, without causing undesired effects. In this mounting technique, although the mounting board affects the electromagnetic field leaking through the slit, the influence thereby is relatively low due to the dielectric residing within the pseudo waveguide tube. For further reduction of this influence, it is possible to provide a depression 15 in the area of the mounting board 11 in which the filter 10 is to be mounted; shown, for example, in FIG. 6. According to the embodiment, described above, a characteristic change between before the mounting process and after the mounting process can be suppressed. Advantages of the flip-chip mounting technique can be obtained for the filter 10 substantially without problems associated with of parasitic inductance and without complications generally associated with the conventional wire bonding process.

Figure 8:
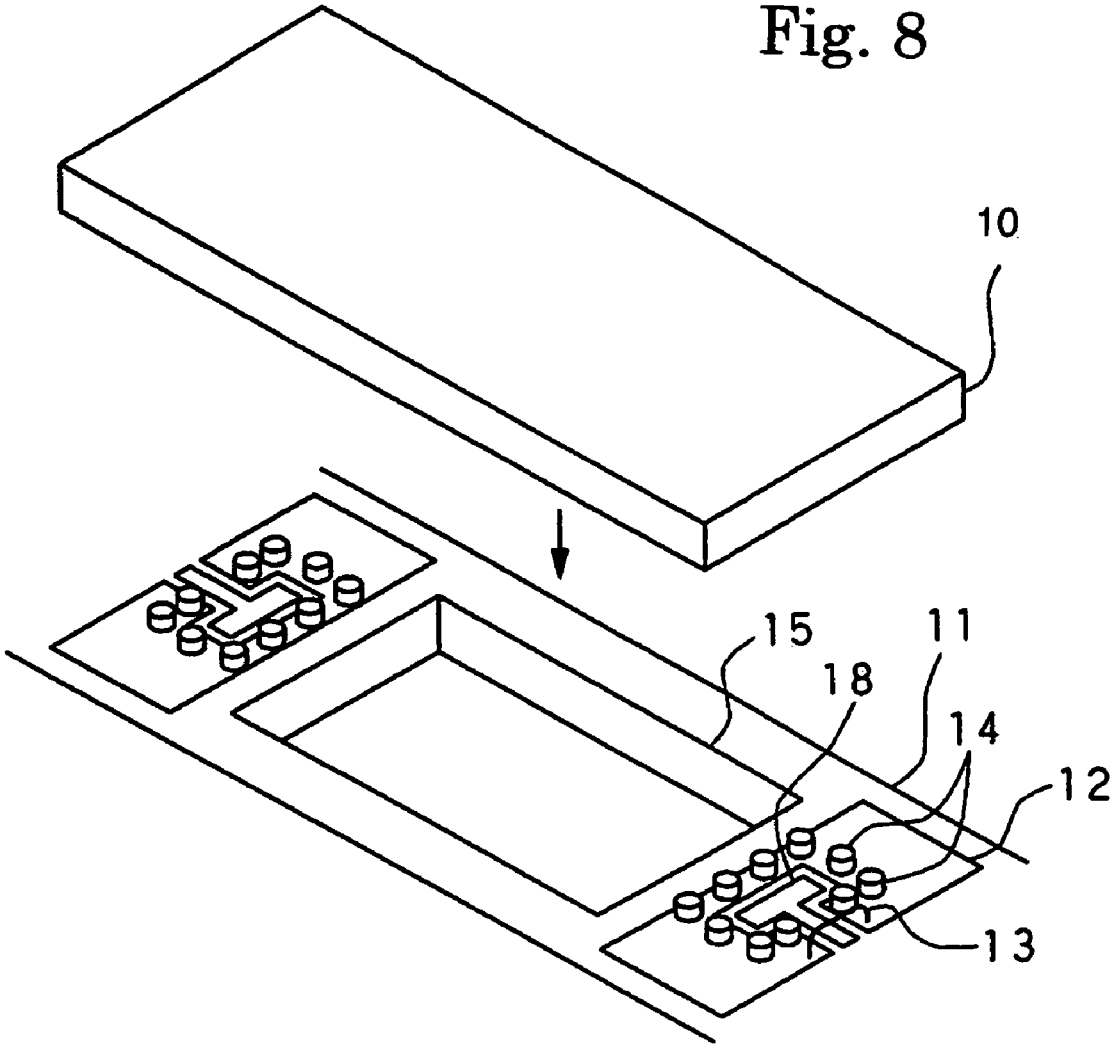
FIG. 8 is an explanatory view of the mounting structure of the filter according to the third embodiment of the present invention.

Referring to FIGS. 7A and 7B, there is shown the schematic structure of a filter 10 according to a third embodiment of the present invention. FIGS. 7A and 7B show the schematic structure of a filter 10 having a four-stage configuration. FIG. 7A is a perspective view thereof, whereas FIG. 7B is a top plan view thereof. The present filter has a main structure similar to that of the filter shown in FIGS. 4A and 4B. Parallel structures previously referenced in the description of FIGS. 4A and 4B are not repeated here. Referring to FIG. 7A, slot line 16 is connected to slit 7 while overlying electrode slit 28. FIG. 8 shows an example of the mounting process of the filter 10 according to the present embodiment. A coplanar waveguide 13 using a conductor pattern 12 is formed on the mounting board 11 on which the filter 10 according to the present embodiment is to be mounted. A slot line/coplanar waveguide conversion section 18 is formed on the tip of the coplanar waveguide. In addition, bumps 14 including gold as a main component thereof are formed on the mounting board 11. The filter is mounted on the mounting board 11 via bumps 14 by using, for example, a heat-press technique. In this technique, the slot line 16 (FIG. 7A) formed on the filter is connected to the coplanar waveguide on the mounting board via the slot line/coplanar waveguide conversion section 18 with an electromagnetic field coupling. As a result, a characteristic change between before the mounting process and after the mounting process can be suppressed, similarly to the second embodiment, and the advantages of the flip-chip mounting technique can be obtained substantially without the problems associated with parasitic inductance generally involved in the wire bonding technique.

Figure 1A:
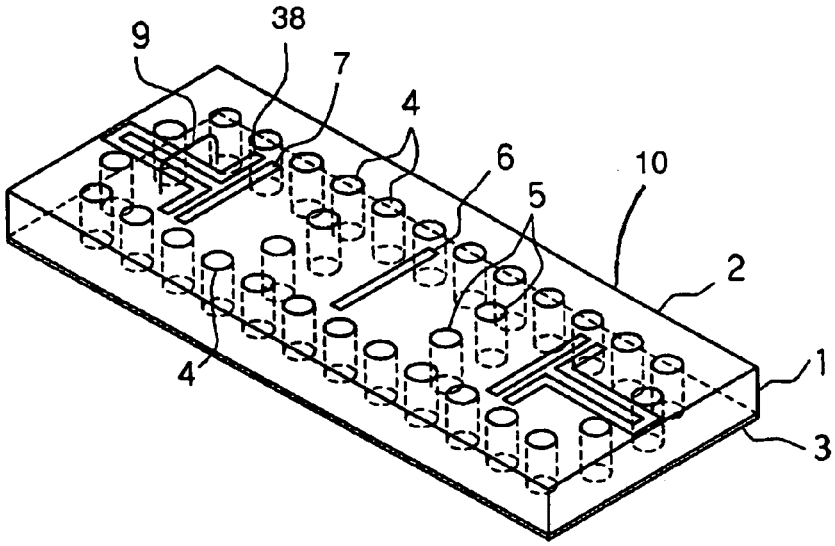
Figure 1B:
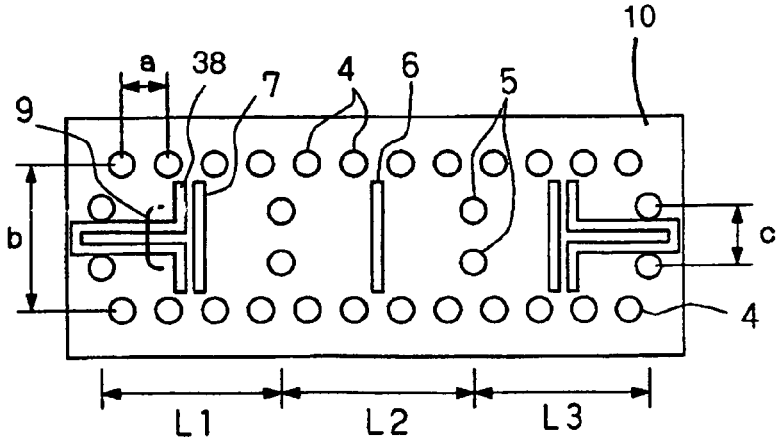

Referring to FIGS. 1A and 1B, there is shown the schematic structure of a filter 10 according to a fourth embodiment of the present invention. FIGS. 1A and 1B show the schematic structure of a filter 10 having a three-stage configuration. FIG. 1A is a perspective view thereof, whereas FIG. 1B is a top plan view thereof. This embodiment best exhibits the features of the present invention. A dielectric substrate 1 (FIG. 1A) is provided with a top conductor 2 formed on one surface thereof, and a bottom conductor 3 formed on the opposite surface thereof. Via-holes 4 connecting together the top conductor 2 and the bottom conductor 3 are formed in two rows along the signal transfer direction. The spacing "a" (FIG. 1B) between adjacent via-holes is preferably equal to or smaller than ½ of the in-tube wavelength. This structure is construed as a pseudo waveguide tube having a waveguide-tube cross section defined by the thickness of the dielectric and the spacing "b" (FIG. 1B) between the via-holes 4 arranged in two rows. In addition, pairs of via-holes 5 are formed in the waveguide tube to configure resonators having cavity lengths of L1, L2 and L3 as shown in FIG. 4B. By suitably selecting the spacing "c" (FIG. 1B) between the via-holes 5 forming a pair, frequencies other than the resonant frequency can be reflected. On the other hand, a signal in the resonant frequency passes therethrough, thereby obtaining a desired filter property.

Figure 10:
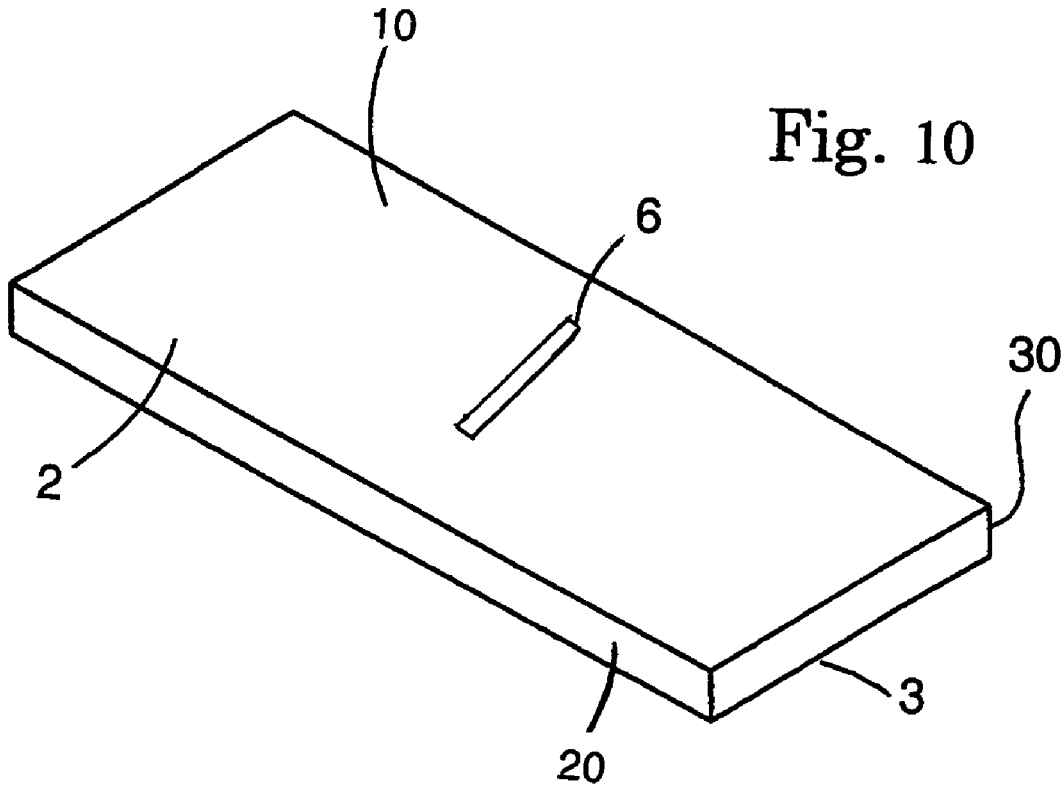
FIG. 10 shows a filter according to another embodiment having pairs of conductor planes on side surfaces of the filter.

FIG. 10 represents another non-limiting waveguide filter 10 embodiment having at least one resonator cavity, a dielectric substrate 1 not shown in FIG. 10 provided with a pair of longer-side conductor planes, relative to the rectangular waveguide filter cross section, a top conductor plane 2 formed on a surface thereof, and a bottom conductor plane 3 formed on the opposing surface thereof. A pair of second conductor planes 20 and 30 is formed on side surfaces of the dielectric substrate. At least one slit 6 is formed by removing a portion of one of the conductor planes 2, 3, 20, or 30, where slit 6 is shown in the top conductor plane 2. A slot line 16, not shown, can be connected to said conductor plane for mounting via bumps 14 (bumps 14 not shown in FIG. 10, but rather shown in FIGS. 5 and 6) as shown and described for a previous embodiment. Alternatively, a coplanar waveguide 9 with corresponding slit configuration as shown in FIGS. 4A–4B, can be used to mount the present filter 10 embodiment, where a coplanar mounting is shown in FIG. 8.

Still referring to FIGS. 1A and 1B, the present filter has a three-stage structure including three resonators therein, wherein a portion of the top conductor 2 overlying the central resonator is provided with a slit 6 formed by partially removing the conductor 2. It is preferable that the slit 6 is arranged to extend in the direction perpendicular to the signal transfer direction. Each portion of the top conductor 2 overlying the outermost end resonator is provided with slits 7 and electrode slits 38 formed by partially removing the conductor 2. A coplanar waveguide 9 is connected to the slit 7. According to the present embodiment, smaller dimensions and lower costs for the filter can be achieved, and the flip-chip bonding technique can be applied thereto, as recited in connection with the descriptions for the first and second embodiments.

According to the first aspect of the present invention, by the configurations wherein a resonator is formed in the rectangular waveguide tube filled with dielectric, and wherein a slit is formed in the longer-side conductor plane of the waveguide structure configuring the resonator, an attenuation pole is configured which improves the suppression performance for the out-of-band signal, whereby the undesired-frequency-band signal can be suppressed in the filter. This allows reduction of the number of stages of the filter to reduce the dimensions thereof, whereby the filter can be manufactured with ease and with lower costs.

The slit, as formed in the waveguide tube structure filled with dielectric, allows reduction of the leakage of the electromagnetic field through the slit due to the electromagnetic field residing mainly within the dielectric, to thereby reduce the influence to the filter characteristic.

According to the second aspect of the present invention, the slit, as formed in the longer-side conductor plane of the waveguide tube configuring the resonator, generates an attenuation pole which improves the suppression performance of the out-of-band signal, whereby the undesired-frequency-band signal can be suppressed in the filter. This allows reduction of the dimensions, fabrication feasibility and lower costs of the filter, similarly to the case of the first aspect of the present invention, whereby influence to the filter characteristic can be reduced even in the case of the filter being mounted in a high-frequency module.

According to the third aspect of the present invention, the slit, as formed in the longer-side conductor plane of the waveguide tube structure configuring the resonator, generates an attenuation pole which improves the suppression property for the out-of-band signal, whereby the undesired-frequency-band signal can be suppressed in the filter. This allows reduction of the dimensions, fabrication feasibility and lower costs of the filter, similarly to the cases of the first and second aspect of the present invention, whereby influence to the filter characteristic can be reduced in the case of the filter being mounted in a high-frequency module.

In the filter of the present invention, if an odd number of the resonators are arranged, and the slit is formed in a portion of the longer-side conductor plane of the waveguide tube structure overlying the central resonator among them, the attenuation pole can be adjusted due to the symmetry without degrading the filter characteristic, thereby providing a filter wherein the frequency at which the attenuation pole appears can be easily adjusted.

In addition, the slit, as formed in the longer-side conductor plane of the waveguide tube structure and extending in the direction perpendicular to the signal transfer direction, allows an efficient adjustment of the frequency at which the attenuation pole appears.

The coplanar waveguide, as formed in the conductor plane configuring the waveguide tube structure and connected to the slit, allows connection to a planar circuit without providing a particular external terminal or using a long-distance wire for connecting to the terminal, whereby the filter can be reduced in the dimensions thereof.

The structure, wherein the coplanar waveguide on the filter and the circuit board on which the filter is mounted are connected together via bumps, allows performing the flip-chip mounting with ease, thereby reducing the man-hours and allowing excellent reproducible connection in the higher-frequency range.

The structure, wherein the slot line is formed in the conductor plane configuring the waveguide tube structure and connected to the slit, allows connection to a planar circuit without providing a particular external terminal and using a long-distance wire for connecting to the terminal, thereby forming the filter in smaller dimensions.

The structure, wherein the slot line on the filter and the circuit board on which the filter is mounted are connected together via bumps, allows performing the flip-chip mounting process with ease, thereby reducing man-hours and allowing excellent reproducible connection in the high-frequency range.

The invention claimed is:

1. A filter comprising:

a rectangular waveguide tube structure, having a rectangular cross-section, filled with a dielectric substrate, a pair of conductor planes disposed on top and bottom surfaces of said dielectric substrate;

having a plurality of conductor via-holes disposed in said dielectric substrate, wherein said plurality of conductor via-holes are arranged to form at least one resonator;

wherein said pair of conductor planes constitutes longer-side conductor planes, with respect to relative dimensions of said rectangular cross-section; and at least one slit is formed by partially removing portions of one of said longer-side conductor planes right over or right under the at least one resonator and is disposed in one of said longer-side conductor planes, wherein said at least one slit extends in a direction perpendicular to a signal transfer direction.

2. A filter comprising:

a rectangular waveguide tube structure, having a rectangular cross-section, filled with a dielectric substrate, a pair of conductor planes disposed on top and bottom surfaces of said dielectric substrate;

having a plurality of conductor via-holes disposed in said dielectric substrate, wherein said plurality of conductor via-holes are arranged to form at least one resonator;

wherein said pair of conductor planes constitutes longer-side conductor planes, with respect to relative dimensions of said rectangular cross-section; and at least one slit is formed by partially removing portions of one of said longer-side conductor planes right over or right under the at least one resonator and is disposed in one of said longer-side conductor planes, wherein a coplanar waveguide is formed on one of said longer-side conductor planes; and said coplanar waveguide is connected to said at least one slit.

3. The filter according to claim 2, wherein said coplanar waveguide is also connected via at least one electrically conducting bump to a circuit board.

4. A filter comprising:

a rectangular waveguide tube structure;

having a rectangular cross-section;

filled with a dielectric substrate;

a pair of conductor planes disposed on top and bottom surfaces of said dielectric substrate, wherein said pair of conductor planes constitutes longer-side conductor planes relative to said rectangular cross-section;

having a plurality of conductor via-holes disposed in said dielectric substrate, wherein said plurality of conductor via-holes are arranged to form at least two resonators;

at least two slits are provided by partially removing portions of one or both of said longer-side conductor planes right over or right under the at least two resonators;

wherein said one of said longer-side conductor planes is a top plane, and said top conductor plane overlying an outermost end resonator is provided with two slits disposed by partially removing said top conductor plane;

said top conductor plane overlying an opposite outermost end resonator is provided with two slits disposed by partially removing said top conductor plane, wherein a slot line is connected to one of two said slits overlying said outermost end resonator; and a slot line is connected to one of two said slits overlying said opposite outermost end resonator.

5. A method for mounting the filter in claim 4, wherein said two slot lines are connected to a mounting board via at least two conducting bumps; and wherein the bumps have negligible parasitic inductance.

6. A filter comprising:

a rectangular waveguide tube structure;

having a rectangular cross-section;

filled with a dielectric substrate;

a pair of conductor planes disposed on top and bottom surfaces of said dielectric substrate, wherein said pair of conductor planes constitutes longer-side conductor planes relative to said rectangular cross-section;

having a plurality of conductor via-holes disposed in said dielectric substrate, wherein said plurality of conductor via-holes are arranged to form at least two resonators;

at least two slits are provided by partially removing portions of one or both of said longer-side conductor planes right over or right under the at least two resonators;

wherein said one of said longer-side conductor planes is a top plane, and said top conductor plane overlying an outermost end resonator is provided with two slits disposed by partially removing said top conductor plane;

said top conductor plane overlying an opposite outermost end resonator is provided with two slits disposed by partially removing said top conductor, wherein a coplanar waveguide is connected to one of two said slits overlying said outermost end resonator; and a coplanar waveguide is connected to one of two said slits overlying said opposite outer-most end resonator, and wherein said two coplanar waveguides are connected to a mounting board via at least two conducting bumps; and wherein the bumps have negligible parasitic inductance.

7. A filter comprising:

a rectangular waveguide tube structure, having a rectangular cross-section, filled with a dielectric substrate, a pair of first conductor planes disposed on top and bottom surfaces of said dielectric substrate, a pair of second conductor planes disposed on side surfaces of said dielectric substrate, wherein said pair of first conductor planes constitute longer-side conductor planes, said rectangular waveguide tube structure configures therein at least one resonator; and at least one slit is formed by partially removing portions of one of said longer-side conductor planes right over or right under the at least one resonator and is disposed in one of said longer-side conductor planes, said filter further comprising: an odd number of said at least one resonators; and said at least one slit is disposed on a portion of one of said longer-side conductor planes above or below a center resonator of said odd number of said at least one resonator.

8. The filter according to claim 7, wherein a slot line is formed on one of said longer-side conductor planes, and said slot line is connected to said at least one slit.

9. The filter according to claim 8, wherein said slot line is also connected to a circuit board with an electromagnetic field coupling surrounded by conducting bumps.

10. A filter comprising:

a rectangular waveguide tube structure, having a rectangular cross-section, filled with a dielectric substrate, a pair of conductor planes disposed on top and bottom surfaces of said dielectric substrate;

having a plurality of conductor via-holes disposed in said dielectric substrate, wherein said plurality of conductor via-holes are arranged to form at least one resonator;

wherein said pair of conductor planes constitutes longer-side conductor planes, with respect to relative dimensions of said rectangular cross-section; and at least one slit is formed by partially removing portions of one of said longer-side conductor planes right over or right under the at least one resonator and is disposed in one of said longer-side conductor planes, said filter further comprising: an odd number of said at least one resonator; and said at least one slit is disposed on a portion of one of said longer-side conductor planes above or below a center resonator of said odd number of said at least one resonator.

11. A filter comprising:

a rectangular waveguide tube structure, having a rectangular cross-section, filled with a dielectric substrate, a pair of first conductor planes disposed on top and bottom surfaces of said dielectric substrate, a pair of second conductor planes disposed on side surfaces of said dielectric substrate, wherein said pair of first conductor planes constitute longer-side conductor planes, said rectangular waveguide tube structure configures therein at least one resonator; and at least one slit is formed by partially removing portions of one of said longer-side conductor planes right over or right under the at least one resonator and is disposed in one of said longer-side conductor planes, and wherein said at least one slit extends in a direction perpendicular to a signal transfer direction.

12. The filter according to claim 11, wherein a coplanar waveguide is formed on one of said longer-side conductor planes; and said coplanar waveguide is connected to said at least one slit.

13. The filter according to claim 12, wherein said coplanar waveguide is also connected via at least one electrically conducting bump to a circuit board.

14. A filter comprising:

a rectangular waveguide tube structure, having a rectangular cross-section, filled with a dielectric substrate, a pair of conductor planes disposed on top and bottom surfaces of said dielectric substrate;

having a plurality of conductor viaholes disposed in said dielectric substrate, wherein said plurality of conductor via-holes are arranged to form at least one resonator;

wherein said pair of conductor planes constitutes longer-side conductor planes, with respect to relative dimensions of said rectangular cross-section; and at least one slit is formed by partially removing portions of one of said longer-side conductor planes right over or right under the at least one resonator and is disposed in one of said longer-side conductor planes, wherein a slot line is formed on one of said longer-side conductor planes; and said slot line is connected to said at least one slit.

15. The filter according to claim 14, wherein said slot line is also connected to a circuit board with an electromagnetic field coupling surrounded by conducting bumps.

* * * * *